United States Patent [19]

Logsdon

[11] 4,122,699

[45] Oct. 31, 1978

[54] TOOL FOR REMOVING DENTS FROM SHEET METAL

[76] Inventor: Cletus R. Logsdon, 530 S. Sage, Rialto, Calif. 92376

[21] Appl. No.: 830,674

[22] Filed: Sep. 6, 1977

[51] Int. Cl.[2] ..... B21D 1/12; B21D 31/02

[52] U.S. Cl. ..... 72/325; 72/705

[58] Field of Search ..... 72/705, 324, 325; 273/106.5 B

[56] References Cited

U.S. PATENT DOCUMENTS

| | | | |
|---|---|---|---|
| 2,684,852 | 7/1954 | Romeka | 273/106.5 B |
| 2,816,765 | 12/1957 | Stockfleth | 273/106.5 B |
| 2,934,984 | 5/1960 | Woodman | 72/705 X |
| 2,949,144 | 8/1960 | Dredske et al. | 72/389 |
| 3,577,881 | 5/1971 | Markovics | 72/705 X |

*Primary Examiner*—C.W. Lanham
*Assistant Examiner*—D. M. Gurley
*Attorney, Agent, or Firm*—John H. Crowe

[57] ABSTRACT

A sheet metal dent removing tool for attachment to an impacting device, the tool tapering to a metal piercing tip and having a narrow side with opposite convex surfaces converging at their edges to form metal shearing ridges. The ridges, forming the outline of the broad side of the tool, are joined to a neck portion by rearwardly converging shoulders so that when the tool has penetrated the metal and is rotated 90° about its axis, the shoulders lock the tool to the metal whereby the impacting device can be used to pull the dented area back to its initial shape.

7 Claims, 7 Drawing Figures

TOOL FOR REMOVING DENTS FROM SHEET METAL

BACKGROUND OF THE INVENTION

1. Field of the Invention

This invention relates to the art of repairing dented or creased sheet metal and has particular reference to a tool for removing dents and the like in sheet metal parts.

2. Description of the Prior Art

Dents formed in sheet metal parts, such as automobile, aircraft or the like body parts, are quite often difficult to remove due to the fact that the dent may occur in a "blind" area where one side of the dented sheet metal part may be inaccessible to be worked on.

One tool used heretofore for such purposes is a self-threading tool driven by a manually operable or power operable impact device. A hold is first drilled in the area of the dented portion of the sheet metal part and the tool is then threaded in the hole, after which the impact device is operated to withdraw the dented area toward its original contour. Subsequently, the tool is removed from the hole and the hole is filled with a suitable filler material, such as self-hardening epoxy plastic or the like. Although such tool and procedure is generally satisfactory it may leave a jagged hole which must be ground down and also, because of the impacting action in pulling the dented area back to its original shape, a reverse dimple may be formed in the immediate area of the dent which must also be ground down or otherwise removed. Further, the threaded hole presents only a relatively small area for the filler material to adhere to. Also, if excessive impacting force is applied when withdrawing the dented area, the threaded connection may be stripped, causing the threaded tool to tear away from the sheet metal.

SUMMARY OF THE INVENTION

It therefore becomes a principal object of the present invention to simplify the removal of dents and creases from a sheet metal part.

Another object is to provide a dent removing tool which adequately locks to the dented area so that it may be used to draw the dented area back to its original shape.

Another object is to provide a single tool for both piercing a dented portion of a sheet metal part and for applying a drawing action to draw the dented area back to its original shape.

Another object is to provide a dent removing tool which both pierces the metal and shapes the same in the immediate area of the pierced opening to enable a strong bond between the metal part and a filler material.

According to the present invention, a metal piercing tool is provided for attachment to an impacting device, the tool being relatively narrow and tapering toward a metal piercing tip, with the opposite surfaces of the narrow side converging at the sides to form metal shearing ridges which diverge rearwardly to form a double concave or double cuspid opening in the metal. During the piercing operation, the metal surrounding the pierced opening is dimpled inwardly to provide a relatively large area for bonding the filler material over the opening. After penetration, the tool is rotated 90° about its axis to form a locking connection with the surrounding portion of the metal to prevent the tool from withdrawing during the dent removing operation.

Due to the above noted construction of the tool, the metal immediately surrounding the opening tends to curl away from the opening during the piercing operation to both strengthen such immediately surrounding area to prevent pull-out of the tool and to enable the filler material to flow behind such opening to positively lock the material in place.

BRIEF DESCRIPTION OF THE DRAWING

The manner in which the above and other objects of the invention are accomplished will be readily understood on reference to the following specification when read in conjunction with the accompanying drawing, wherein.

Figure 1:
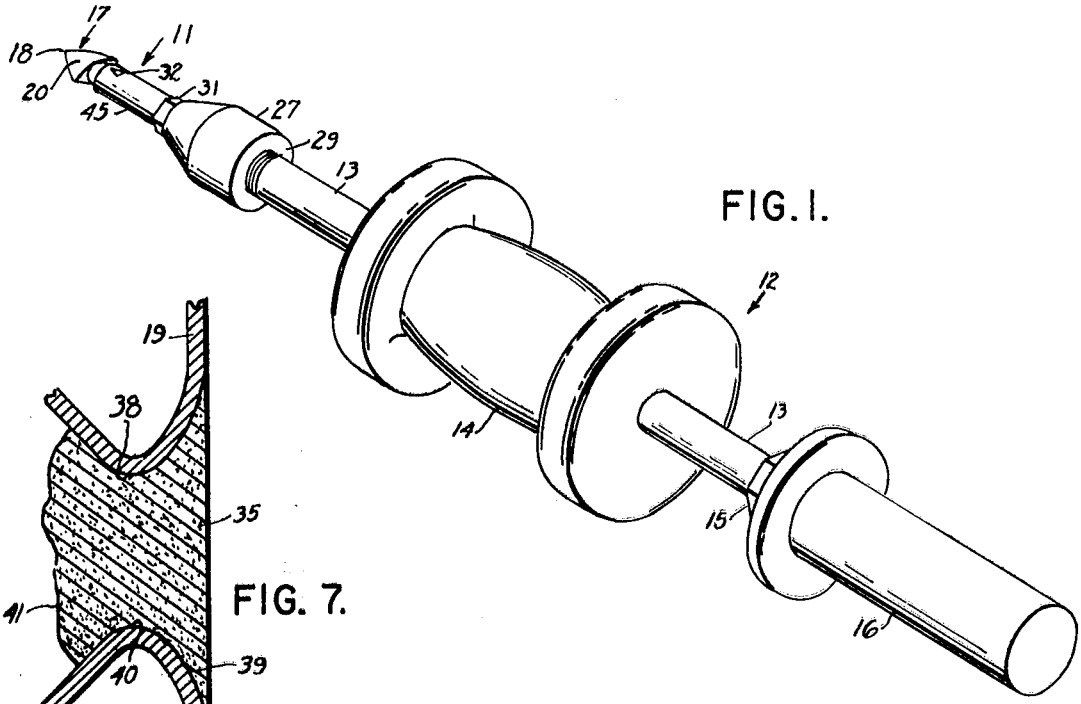
FIG. 1 is a perspective view of a dent removing tool embodying a preferred form of the present invention and illustrating the same attached to a manually operable impacting device.

Referring to the drawing, the tool of the present invention is illustrated generally at 11 and is shown attached to a manually operable impacting tool generally indicated at 12. The latter comprises a shaft 13 along which a weighted handle 14 is slidable. A stop 15 and handle 16 are attached to the right hand end of the shaft 13.

Figure 2:
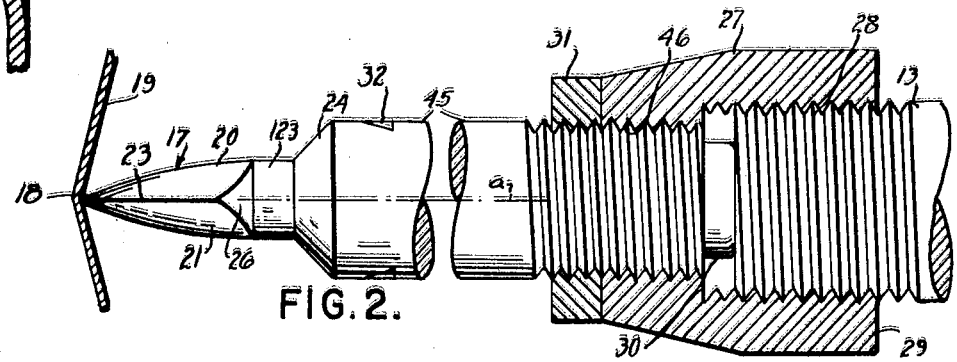
FIG. 2 is a longitudinal sectional view illustrating the dent removing tool and its attachment to the impacting device, the tool being shown in the initial stage of penetrating a dented portion of a sheet metal part.
Figure 3:
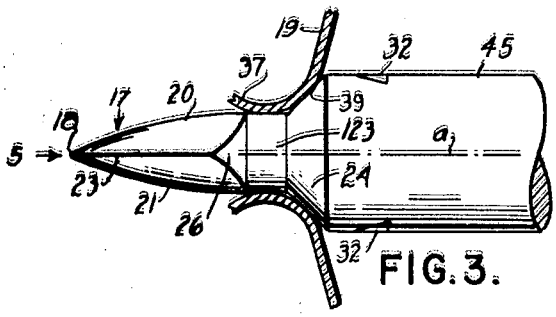
FIG. 3 is a view similar to that of FIG. 2 but showing the tool and sheet metal part after complete penetration of the tool.
Figure 5:
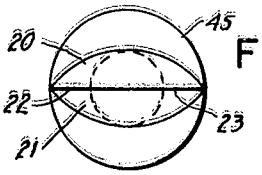
FIG. 5 is a front view of the tool per se, taken in the direction of arrow of FIG. 3.
Figure 4:
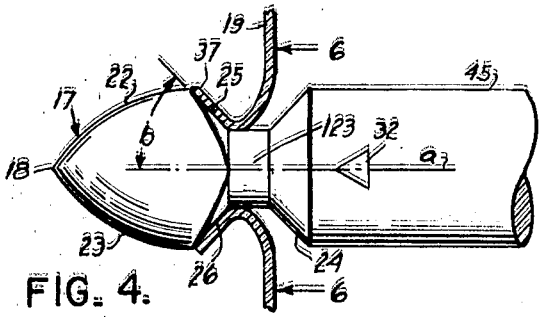
FIG. 4 is a sectional view similar to that of FIG. 3 but illustrating the tool rotated 90° about its axis.

The tool 11 is formed of hardened steel or the like and comprises a metal penetrating head 17 having a narrow side, as viewed in FIGS. 2 and 3, and a broad side oriented 90° from the narrow side, as seen in FIG. 4, both sides tapering to a sharp metal piercing tip 18 located on the axis *a* of the tool. As seen in FIGS. 2, 3 and 5 the opposite surfaces 20 and 21 of the narrow side of the head 17 are shaped convexly and converge to form sharp metal shearing ridges 22 and 23. Also, when viewed in FIGS. 2 and 3, it will be noted that the surfaces of 20 and 21 diverge rearwardly in a convex manner and the outermost portions of such surfaces, as viewed in these figures, blend with a cylindrical neck portion 123 extending concentrically about the axis *a*.

The broad side of the head 17, as viewed in FIG. 4, and as defined by the shearing ridges 22 and 23 also diverges rearwardly in a convex manner from the tip 18. The ridges 22 and 23 are joined to the neck portion 123 by rearwardly converging shoulders 25 and 26, respectively, each of which extends at an angle *b* of 45° to the axis *a*.

The neck portion 123 is joined by a rearwardly diverging conical surface 24 to a shank 45 which is screw-threaded at 46 to a collet 27. The collet is screw-threaded at 28 to the forward end of the impact tool shaft 13 to maintain the latter in abutting engagement with a reduced end portion 30 formed on the rear end of shank 45. The shank 45 is securely locked in place in the collet by a lock nut 31.

One or more indicia 32 are formed on the tool shank 45 to indicate the position of the broad and narrow sides of the head 17 so that such positions may be readily determined even when the tool has fully penetrated the metal in a "blind" location where the head cannot be seen from outside the outer surface of the metal.

In operation, the tip 18 of the tool is held against the dented area of a sheet metal part, i.e. 19. If such dented area is creased, the ridges 22 and 23 are preferably aligned with the crease and while being held in such position, the weighted handle 14 is repetitively slid endwise to impact against the end surface 29 of the collet 27 to drive the tip 18 into the metal part 19. As the tool pierces the metal part, the ridges 22 and 23 cause a shearing action to readily penetrate the metal and the convex opposite surfaces 20 and 21 of the narrow side of the tool curl the part 37 of the metal immediately surrounding the pierced opening 38 into the shape shown in FIG. 3, thus strengthening such area of the metal. Concurrently, the hammering action of the tool 11 causes the area surrounding the pierced opening 38 to be dimpled inward slightly as indicated at 39 (see also FIG. 7). After complete penetration of the head 17 as indicated in FIG. 3, the tool is rotated approximately 90° about its axis *a*, causing the shoulders 25 and 26 to further curl the part 37 rearwardly as seen in FIG. 4 and to lockably engage behind the curled section, thus further strengthening the metal at this point to prevent subsequent pull-out of the head 17.

In the event further inward dimpling is desired, the tool is driven in further causing the conical surface 24 to strike the face of the metal 19 surrounding the pierced opening 38 and thus deepen the dimple 39. Thereafter, the weighted handle 14 is repetitively slid against the stop 15 to drive the dented area outwardly. Finally, the tool 11 is again rotated approximately 90°, aligning the head 17 with the opening 38 so that it may be easily withdrawn.

Figure 7:
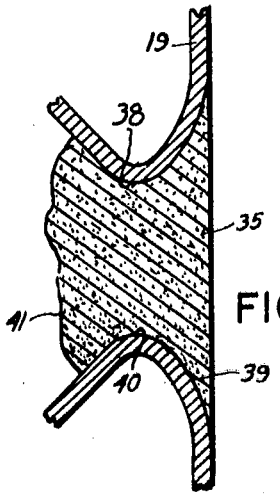
FIG. 7 is an enlarged sectional view through a pierced area of a sheet metal part, illustrating the same after being filled with a suitable filler material.

As seen in FIG. 7, a suitable filler material 35, such as self-hardening epoxy plastic or filler may be pressed, while in plastic form, into the opening 38 to fill the same. Due to the resulting rounded formation 40 of the opening 38, the plastic filler material 35 tends to flow outwardly behind the opening as seen at 41 to form a locking formation to prevent withdrawal of the filler material after the latter hardens. Also, because of the resulting inwardly dimpled area 39, a relatively large surface area is provided to enable adequate bonding of the filler material to the sheet metal part. After the filler material has hardened, it may be ground, as by sanding, to conform to the remaining surface contour of the metal.

Figure 6:
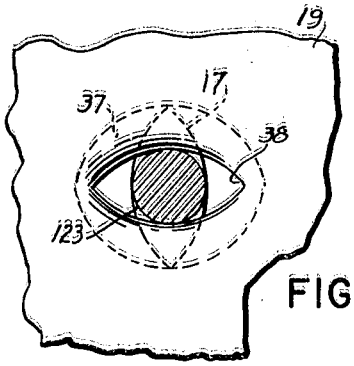
FIG. 6 is a transverse sectional view taken along the line 6—6 of FIG. 4.

It will be obvious to those skilled in the art that many variations may be made in the exact construction shown without departing from the spirit or scope of this invention. For example, it has been found that the angle *b* of the shoulders 25 and 26 may be varied from 35° to 55° and still provide the desired results without tendency for the head 17 to pull out of the hole 38 while oriented in the position shown in FIG. 6.

Also, the tool 11 may be used for other applications. For example, it may be used to penetrate and break spot-welded connections between two sheet metal parts by piercing the parts in the area of each spot weld.

Although the tool 11 is illustrated as being screw threadedly connected to the collet 27 it may be coupled in any other suitable manner to the impact tool shaft. For example, it may have a tapered end arranged to fit within a correspondingly tapered hole in the collet or in the impact tool shaft. Or, it may be welded, clamped or otherwise connected to the impact tool shaft for use, either with or without an intervening collet. Hereinafter, for lack of a better term, any such means of coupling the tool and impact tool shaft together (temporarily or permanently) for use will be thought of as "means of attachment" of the former to the latter and referred to in like manner. It will be appreciated, of course, that where the means of attachment is a male and female arrangement like the mating tool (tapered) and hole arrangement referred to above, the tool can only be used for hole punching and or spot weld braking purposes, unless it has some means for firmly holding the mated parts against separation during dent pulling usage as well. In this connection, my novel tool can be designed purely for hole punching and spot weld breaking purposes if desired, in which case there will be no need for the neck (123) and shoulder (25, 26) configuration of tool 11.

It should be understood that the tool of the present invention lends itself to usage with either a manually or power driven (e.g., a pneumatic) impact device. When the tool, in any of its forms, is being employed for punching holes and/or breaking spot welds, it is better to drive it with a powered impact device than by hand because this results in a great savings in time and makes the work far less fatiguing than it otherwise would be.

I claim:

1. In a device for removing dents in sheet metal, a tool comprising:

a metal piercing head, means permitting use of said head with an impacting device whereby it can be driven through said sheet metal, said head having two integral, symmetrically opposite narrow sides tapering, where they merge, to a pointed metal piercing tip, said head also having two integral, symmetrically opposite broad sides tapering, where they merge, toward said tip, said broad sides converging along their side edges to form metal shearing ridges extending along the length of said head, and said broad side being convex in cross-section throughout whereby said head forms a double cuspid opening with inturned lips in said sheet metal when driven therethrough by means of said impacting device.

2. A tool in accordance with claim 1 in which said head includes a neck portion spaced from said tip and the symmetrically opposite narrow sides taper, where they merge, from opposite sides of said neck portion to said tip, and rearwardly converging shoulders interconnecting said neck portion and said ridges adapted to drivingly engage the lips of said double cuspid opening in said metal when said tool is rotated about an axis extending lengthwise thereof after forming the opening and before it is withdrawn therefrom, the thickness of said neck portion being such as to provide shoulders with lip abutting surfaces of sufficient width to seat against and drivingly engage the lips in a manner to draw the surrounding metal outwardly without cutting through it when said tool is so rotated and properly directed driving force is applied to said head.

3. A tool in accordance with claim 2 in which said narrow sides extend convexly rearwardly from said tip to said neck portion and wherein said ridges extend convexly rearwardly about said axis.

4. A tool in accordance with claim 3 in which each of said rearwardly converging shoulders extends, along its median line, at an angle of from about 35° to about 55° with the axis of said head.

5. A tool in accordance with claim 4 in which said angle is about 45°.

6. A tool in accordance with claim 4 having a rearwardly diverging conical surface, contiguous with said neck portion, spaced rearwardly of said shoulders.

7. A tool in accordance with claim 6 having indicia thereon to the rear of said diverging conical surface to indicate the position of at least one of the narrow and broad sides of said head.

* * * * *